US005740610A

United States Patent [19]

Ayer et al.

[11] Patent Number: 5,740,610

[45] Date of Patent: Apr. 21, 1998

[54] CARTON OPENER

[75] Inventors: Kylle R. Ayer, Watebury; Tom Zamecnir, Clinton; Lloyd Ayer, Bethany, all of Conn.; Attila Bodnar, Cliffside Park, N.J.

[73] Assignee: General Housewares Corp., Terre Haute, Ind.

[21] Appl. No.: 110,567

[22] Filed: Aug. 23, 1993

[51] Int. Cl.[6] ..... B26B 3/08

[52] U.S. Cl. ..... 30/2; 30/294

[58] Field of Search ..... 30/2, 294, 293, 30/289, DIG. 3

[56] References Cited

U.S. PATENT DOCUMENTS 4,467,524 8/1984 Ruff et al. ..... 30/2

4,503,612 3/1985 Davis ..... 30/294 X 5,285,574 2/1994 Feltner ..... 30/2

*Primary Examiner*—Douglas D. Watts

*Attorney, Agent, or Firm*—Emrich & Dithmar

[57] ABSTRACT

An apparatus includes a body member which has a pair of guide surfaces. A blade projects from a first of the guide surfaces and the cutting edge of the blade forms an acute angle with the first guide surface. The plane of the blade forms an acute angle with the second guide surface thereby facilitating a clean cutting action. The angle of the plane of the blade effectively maintains contact between the guide surfaces and the carton being opened and minimizes any tendency for the carton opener to leave the cut. The body member includes a curved portion forward of the blade and a projecting wall portion which serve to position the hand of the user in the correct ergonomic position for safe and efficient operation.

1 Claim, 4 Drawing Sheets

CARTON OPENER

BACKGROUND OF THE INVENTION

This invention relates generally to the field of carton openers and more particularly to a carton opener which includes a blade guard for protection of the user and which combines efficient and convenient operation with protection for the goods stored in the carton against inadvertent damage.

The prior art related to carton openers includes various devices included among which is U.S. Pat. No. 1,941,680 to L. W. Goldstein, titled Paper Carton Opener, which shows a guide member which incorporates a pair of walls which form a dihedral angle and one of which holds a cutting blade. The cutting blade is adapted to extend into a side wall of a corrugated paper carton and the device is moved by hand in order to produce a cut which is parallel to a wall of the guide. The blade is held in a fixed position relative to the walls of the guide member which form the dihedral angle and the blade is generally perpendicular to one of the walls. The blade thus is constantly exposed resulting in the possibility of accidental injury to the user and dulling of the blade due to accidental contact with other objects during storage and possible damage to these other objects. In addition, the guide member is made of metal, resulting in significant weight and making the device awkward to use, especially when opening relatively small cartons.

An additional disadvantage is related to the handle portion which is formed as a relatively flat projecting member which is arranged longitudinally with respect to the device and extending from one of the dihedral walls. This configuration of the handle results in difficulty in accomodating the hand of the user. In addition, the longitudinal orientation of the handle encourages the user to apply a pushing force to the device in only the longitudinal direction with the result that the user cannot be certain that the cutting of a carton is being accomplished in a safe and effective manner. This generally longitudinal application of force can result in the device being pushed out of the cut being made in a carton and requiring restarting of the cut.

OBJECTS AND SUMMARY OF THE INVENTION

It is an object of the present invention to provide a carton opener which facilitates the opening of cartons in a safe and effective manner.

Another object of the present invention is to provide a carton opener which incorporates an ergonomic handle which correctly positions the hand of the user thus preventing fatigue during use.

Another object of the present invention is to provide a carton opener in which the edge of the blade is angled with respect to the guide walls, thereby providing a clean cutting action when used on a corrugated paper carton.

Another object of the present invention is to provide a carton opener in which the plane of the blade is angled with respect to the guide walls, thereby providing protection for the contents stored within the carton during the use of the carton opener.

Another object of the present invention is to provide a carton opener which is light in weight.

Another object of the present invention is to provide a carton opener which protects the user against accidental contact with the blade and also protects the blade against accidental contact with objects during storage of the apparatus, thereby protecting the blade against dulling or breakage.

Yet another object of the present invention is to provide a carton opener which includes a relatively small number of component parts which are relatively simple to manufacture in high volume resulting in a relatively low unit cost.

The foregoing and other objects and advantages of the invention will appear more clearly hereinafter.

In accordance with the present invention, there is provided a carton opener which includes a body member which has a pair of guide surfaces. A blade projects from a first of the guide surfaces and the cutting edge of the blade forms an acute angle with the first guide surface thereby facilitating a clean cutting action. The plane of the blade forms an acute angle with the second guide surface thereby protecting the contents of the carton during the use of the carton opener. In addition, the angle of the plane of the blade effectvely maintains contact between the guide surfaces and the carton being opened and minimizes any tendency for the carton opener to leave the cut.

The body member includes a curved portion forward of the blade and a projecting wall portion which serve to position the hand of the user in the correct ergonomic position for safe and efficient operation. The combination of the curved portion and the projecting wall portion enable a user to pull the carton opener during use without bending his wrist thereby reducing fatigue and increasing productivity.

The blade is protected against accidental contact by a blade guard which is locked in place and which can be released by depressing a release button. After the release button is depressed, the blade guard continues to cover the blade until the blade is inserted into a carton. A spring returns the blade guard to the locked position as soon as the blade is withdrawn from the cut being made in the carton.

DESCRIPTION OF THE DRAWINGS

Other important objects and advantages of the invention will be apparent from the following detailed description taken in conjunction with the accompanying drawings in which.

DETAILED DESCRIPTION OF THE INVENTION

Figure 1:
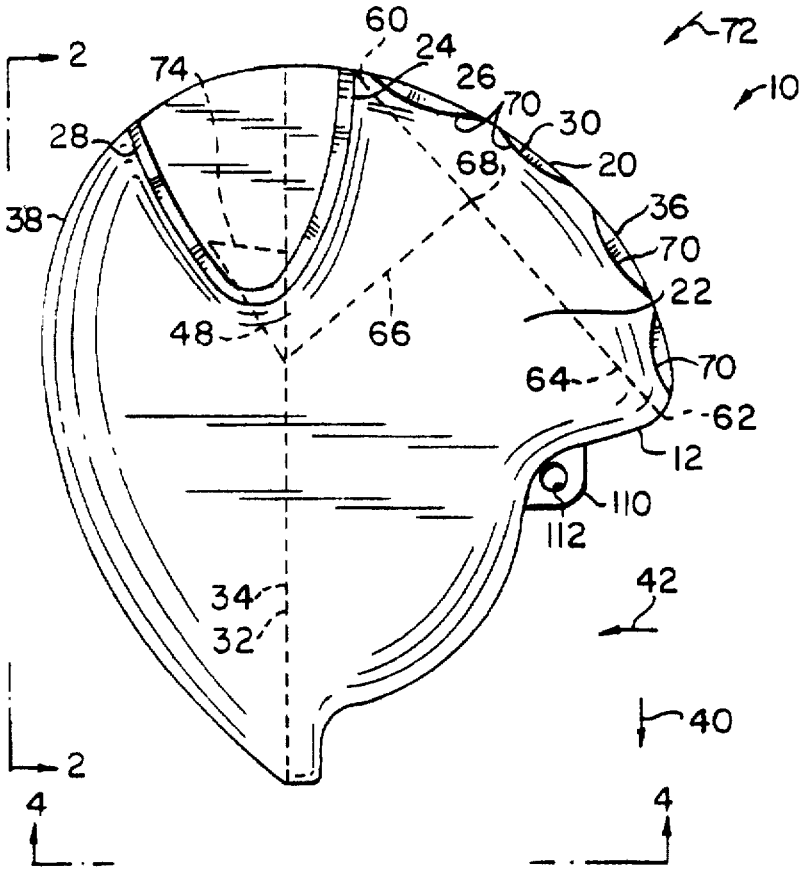
FIG. 1 is a top plan view of the carton opener of the present invention.
Figure 2:
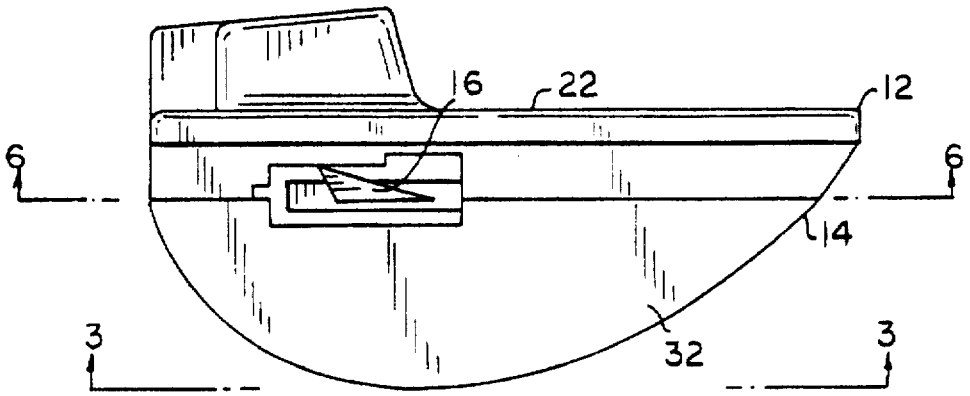
FIG. 2 is a side elevation view of the carton opener of FIG. 1 taken along the line 2—2 of FIG. 1.

With reference to the drawings there is shown in FIGS. 1 and 2 a carton opener 10 made in accordance with the present invention which includes a body member 12, a cover portion 14, a blade 16 and a blade guard 18.

The body and cover members 12,14 form an ergonomic handle which promotes the placement of the user's hand in the correct position for efficient operation in a manner which will be presently described.

The cover and body members 12,14 together have a forward portion 20 which is convexly curved thereby accomodating the convenient placement of the user's fingers. The upper surface 22 of the body member 12 is generally flat thereby accomodating the palm of the user's hand.

A curved wall portion 24 which projects upwardly from the forward portion 26 of the upper surface 22 of the body member 12 guides the user toward the placement of his hand with the thumb alongside the surface 28 and the fingers grasping the area 30. The wall portion 24 and the curved portion 20 automatically position the user's hand in the correct position and enables a user to grasp and use the carton opener 10 for extended periods of time without fatigue. In addition, the relationship of the forward portion 20 and the curved wall portion 24 is formed in a predetermined and advantageous manner with respect to the integrally formed guide surface 32, the position of which is indicated by the broken line 34 in FIG. 1, and the blade 16.

Figure 3:
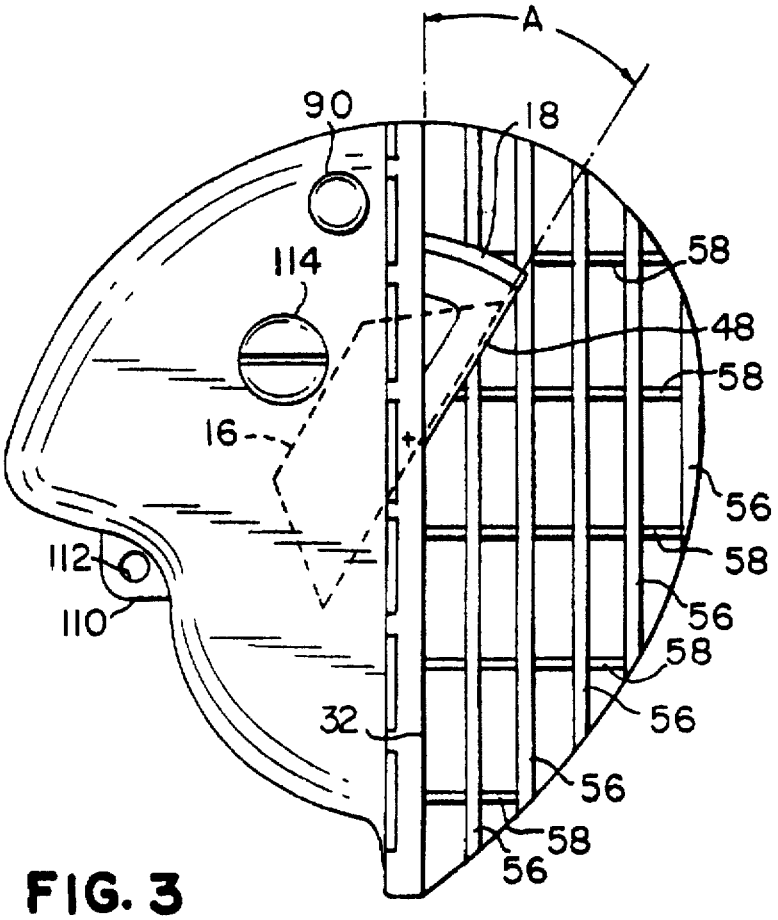
FIG. 3 is a bottom plan view taken along the line 3—3 of FIG. 2.
Figure 4:
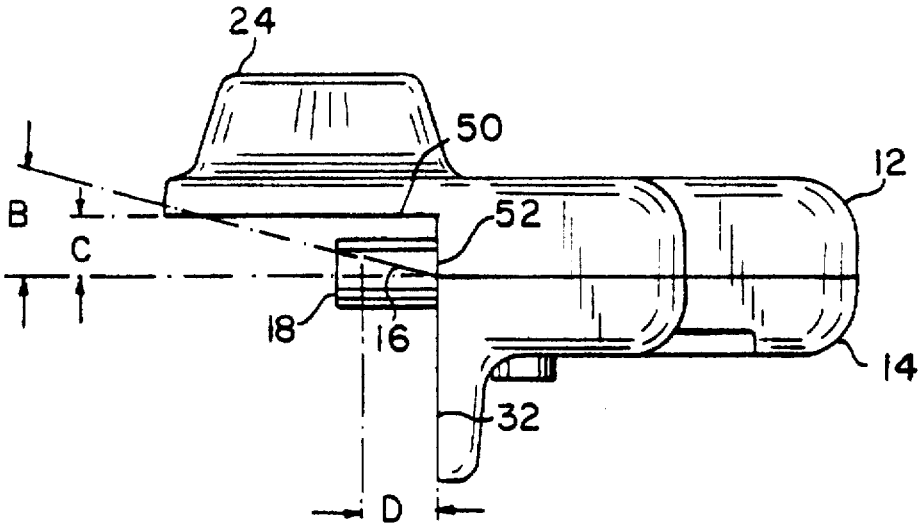
FIG. 4 is a side elevation view taken along the line 4—4 of FIG. 3.
Figure 5:
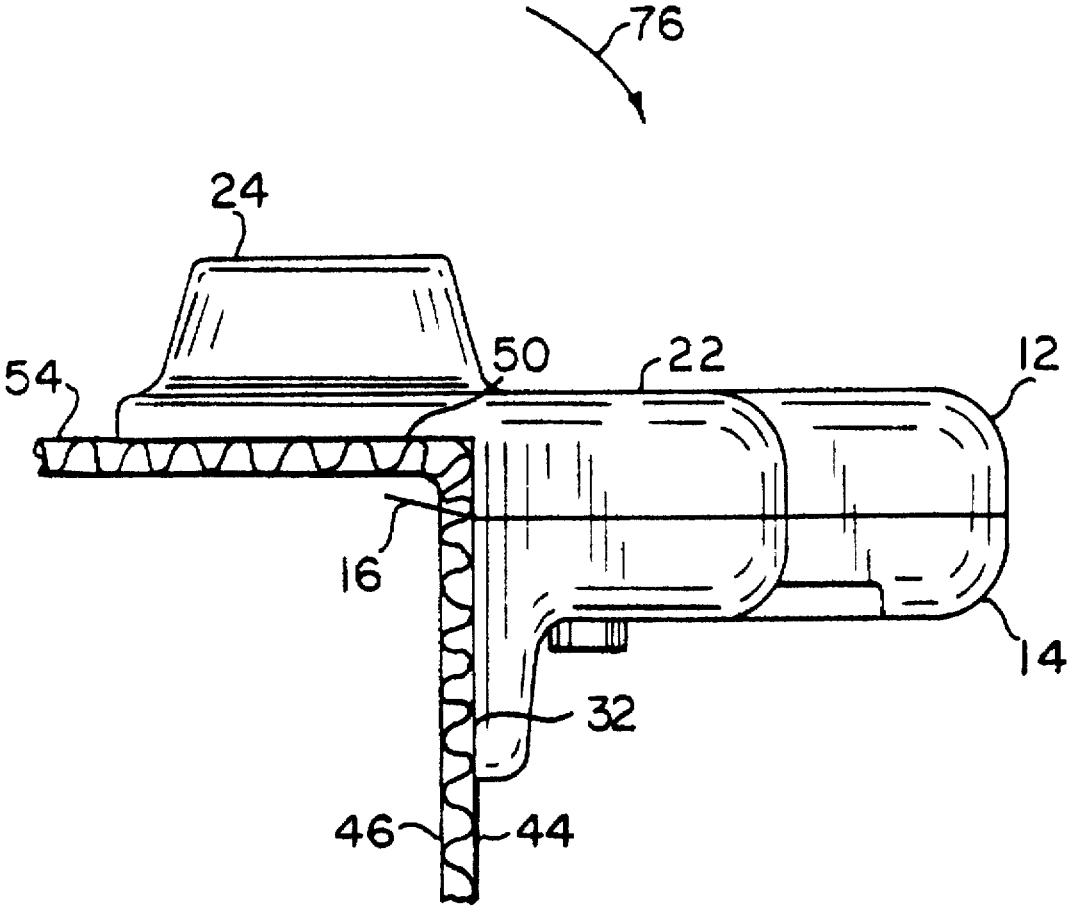
FIG. 5 is a view similar to FIG. 4 showing a cross-section of a carton being cut.

As is best shown in FIGS. 1, 3 and 4 the vertical guide surface 32 is positioned near the center of the body portion 12 and portions 36, 38 of the curved forward portion 20 extend nearly equally on either side of the vertical guide surface 32. This positioning of the vertical guide surface 32 automatically encourages positioning of the user's fingers on the area 30, as described above and enables a user to conveniently apply a force which has a component parallel to the vertical guide surface 32, shown by the arrow 40 in FIG. 1, and which also has a component which is perpendicular to the vertical guide surface 32, shown by the arrow 42 in FIG. 1. The component of force 42 thereby continuously and conveniently keeps the vertical guide surface 32 of the carton opener 10 in contact with the wall 44 of a carton 46 being opened as is shown in FIG. 5. This action keeps the blade 16 continuously engaged in the cut and prevents the blade 16 from leaving the cut, which would require a restart of the cut.

Another feature of the present invention is shown in FIG. 1. The area in which the user's fingers contact the body member 14 is designated generally by the numeral 30 and extends between the location designated by the numeral 60 and the location designated by the numeral 62. For purposes of reference these two points 60,62 have been connected by a broken line 64. A line 66 which passes through a point 68 which is close to the center of the line 64 generally represents the line of action of the force vector which is applied by the user's hand. The point 68 is slightly closer to the wall portion 24 as a result of the greater force typically exerted by the first two fingers of a user's hand. The direction of this force vector is shown by the arrow 72 in FIG. 1. As is shown in FIG. 1 the force vector 72 passes through the cutting edge 48 of the blade 16, which is shown in broken line 74, thereby ensuring the efficient and effective application of the user's effort.

In addition, the flat portion 22 of the body 12 and the above described relationship between the area 30 and the blade 16 enables a user to cut open a carton with a simple pulling motion of the arm and with his wrist in a straight and unflexed position. This minimizes operator fatigue and permits continuous use of the carton cutter 10 for extended periods of time. During use the user's hand rests on the portion 22 of the body 12 and the weight of the user's hand tends to rotate the carton opener 10 in the direction shown by the arrow 76 in FIG. 5. This ensures that the guide surface 32 is in continuous contact with the wall of the carton 46 thereby resulting in an effective cutting action.

The portion 30 includes four shallow depressions 70 which ensure the correct placement of the user's fingers.

The cutting edge 48 of the blade 16 forms an angle with the vertical guide surface 32, denoted by the reference letter A in FIG. 3, and having a preferred value in the order of 30 degrees. The plane of the blade 16 forms an angle with the horizontal guide surface 50, which is denoted by the reference letter B, and which has a range of 10 degrees to 20 degrees, with a preferred value in the order of 15 degrees.

The angle A of the cutting edge 48 of the blade 16 ensures a clean cutting action while the angle B of the plane of the blade 16 ensures the protection of the contents stored in the carton 46.

As is best shown in FIG. 4, the intersection of the blade 32 and the vertical guide surface 32, denoted by the reference number 52, has a preferred elevation distance of 0.44 inches above the horizontal guide surface as 50, denoted by the reference letter C. The maximum projection of the blade 16, as denoted by the reference letter D, has a preferred value in the order of 0.50 inches. This value combined with the angle B of the plane of the blade 16 ensures that the carton opener 10 will cut a carton open without damaging the goods stored within the carton. The fixed position of the blade 16 with respect to the horizontal and vertical guide surfaces 50, 36 prevents inadvertent misadjustment of the blade 16 such as positioning the blade 16 at too great a distance from the top surface 54 of a carton 46 which consequently results in inadvertent damage to goods stored within the carton.

The horizontal guide surface 50 is formed by a plurality of relatively narrow and generally parallel surfaces 56 which form a grillwork in common with a plurality of transverse members 58. The surfaces 56 are parallel to the direction of motion 40 of the carton opener 10. During use, the narrow surfaces 56 help reduce the friction between the carton opener 10 and a corrugated carton being opened by accomodating irregularities in the surface 54 of the carton.

In addition, the grillwork construction also serves to reduce the weight of the carton opener 10 and provides increased stuctural strength.

The blade guard 18 is pivotally mounted on the cover 14 and the body 12 by means of the pivot shafts 80, 82. The blade guard 18 has an upper wall portion 84, a lower wall portion 86 and a front wall portion 88. The blade guard extends beyond the dimensions of the blade 16 and prevents inadvertent contact with the blade 16. The motion of the blade guard 18 is controlled by the blade guard release button 90 which is mounted in the body 12.

Figure 6:
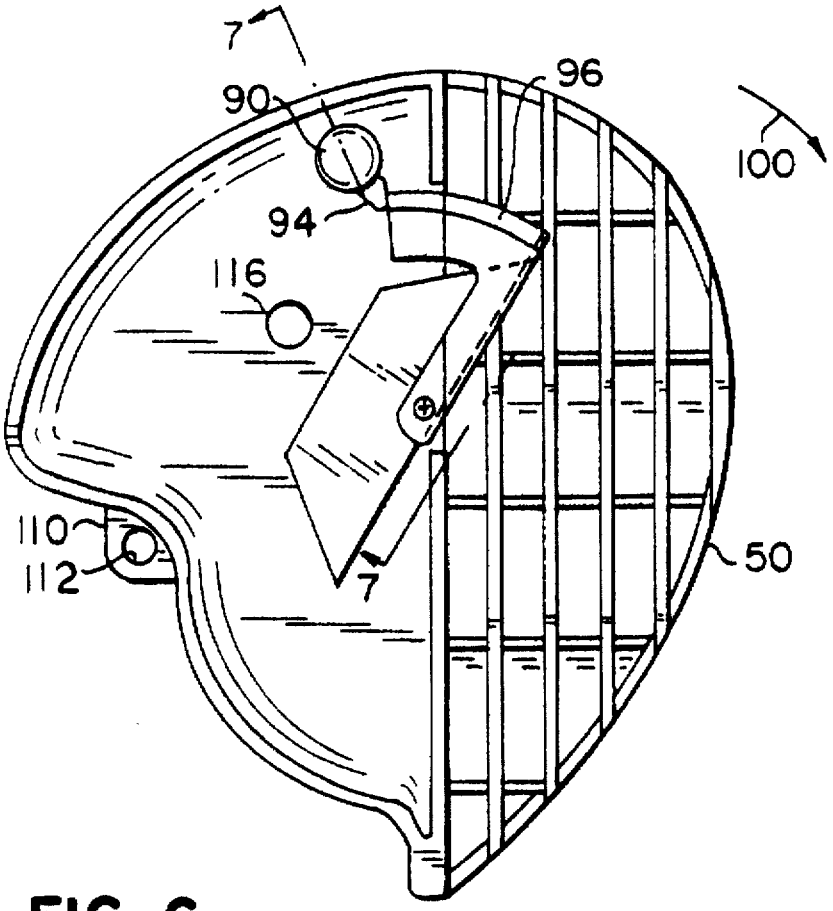
FIG. 6 is a view taken along the line 6—6 of FIG. 2 showing the cover removed.
Figure 7:
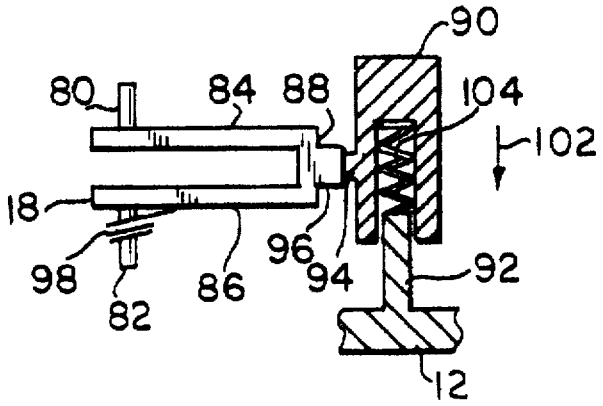
FIG. 7 is a fragmentary view partially in section taken along the line 7—7 of FIG. 6.

As is best shown in FIGS. 6 and 7, the blade guard release button 90 is slideably mounted on a guide member 92 which is integrally formed as part of the body 12. The blade guard release button 90 has a projecting tab 94 against which a ridge 96 formed on the front wall 88 of the blade guard 18 abuts. A torsional spring 98 causes the blade guard 18 to rotate in the direction shown by the arrow 100 in FIG. 6. The blade guard 18 continues to cover the blade 16 until the blade guard release button 90 is depressed in the direction shown by the arrow 102 thereby overcoming the helical compression spring 104 and moving the tab 94 out of alignment with the ridge 96. When the blade guard release button 90 is depressed, the spring 98 continues to prevent exposure of the blade 16 until the blade 16 is inserted in the wall of a carton.

When the blade 16 is removed from the cuts the torsional spring 98 again forces the blade guard 18 to cover the blade 16 and the blade guard release button 90 again locks the blade guard 18.

An additional safety feature provided by the carton opener 10 of the present invention is related to the construction of the body 12 and the vertical guide surface 32 and the horizontal guide surface 50. As is best shown in FIGS. 2, 4 and 6, the vertical and horizontal guide sufaces 32 and 50 each project a substantial distance beyond the blade 16 so that even if the blade guard 18 fails to operate in the manner described, the vertical and horizontal guide surfaces 32, 50 would protect a user from coming into contact with the blade 16.

A tab 110 having a hole 112 is provided projecting from the body 12 in order to facilitate hanging up the carton opener 10 when not in use.

The body 12 and the cover 14 are connected by a screw 114 which engages a threaded hole 116 in the body 12. The body 12 and the cover 14 are typically made of a moldable plastic material resulting in a lightweight and high strength unit.

The foregoing specific embodiment of the present invention as set forth in the specification herein is for illustrative purposes only. Various changes and modifications may be made within the spirit and scope of the invention.

What is claimed is:

1. A carton opener comprising:

a body member, a first guiding surface formed on said body member, a second guiding surface formed on said body member with said first and said second guiding surfaces forming an angle, a blade member with said blade member projecting from said first guiding surface and with said blade member defining a plane and with said blade member having a cutting edge and with said body member having a curved portion disposed forward of said cutting edge, further comprising a blade guard with said blade guard pivotally connected to said body member and capable of a first position covering said blade, locking means mounted on said body member and disposed to lock said blade guard in said first position, and release button means capable of releasing said blade guard.

* * * * *